US008903272B2

(12) United States Patent
Tanaka et al.

(10) Patent No.: US 8,903,272 B2
(45) Date of Patent: Dec. 2, 2014

(54) IMAGE FORMING APPARATUS INCLUDING CHARGING UNIT POSITIONING

(75) Inventors: Arichika Tanaka, Kanagawa (JP); Kuniaki Tanaka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 31 days.

(21) Appl. No.: 13/453,557

(22) Filed: Apr. 23, 2012

(65) Prior Publication Data

US 2013/0121730 A1 May 16, 2013

(30) Foreign Application Priority Data

Nov. 15, 2011 (JP) ..... 2011-249889

(51) Int. Cl.
*G03G 15/02* (2006.01)

(52) U.S. Cl.
CPC ..... *G03G 15/02* (2013.01); *G03G 15/0216* (2013.01)
USPC ..... 399/115; 399/168

(58) Field of Classification Search
CPC ..... G03G 15/0126; G03G 15/0266
USPC ..... 399/115, 168
See application file for complete search history.

(56) References Cited

U.S. PATENT DOCUMENTS

| | | | | |
|---|---|---|---|---|
| 5,666,608 | A * | 9/1997 | Christensen | 399/176 |
| 2007/0053718 | A1* | 3/2007 | Choi | 399/159 |
| 2008/0253805 | A1 | 10/2008 | Yoshino | |
| 2010/0239320 | A1* | 9/2010 | Eder et al. | 399/170 |
| 2011/0217079 | A1* | 9/2011 | Ishii | 399/168 |
| 2011/0222901 | A1* | 9/2011 | Makino | 399/98 |

FOREIGN PATENT DOCUMENTS

JP 2008-262114 A 10/2008

* cited by examiner

*Primary Examiner* — Walter L Lindsay, Jr.
*Assistant Examiner* — Philip Marcus T Fadul
(74) *Attorney, Agent, or Firm* — Sughrue Mion, PLLC

(57) ABSTRACT

An image forming apparatus includes a latent-image forming member including a latent-image carrier and support members disposed at both ends of the latent-image carrier to support the latent-image carrier, a charging member including a discharge electrode that supplies an electric charge to the latent-image carrier and a control electrode that is disposed between the discharge electrode and the latent-image carrier and controls a potential of the latent-image carrier, a first connecting portion and a second connecting portion that are respectively formed on the latent-image forming member and the charging member and that are connected to each other to connect the latent-image forming member and the charging member to each other, and an urging member that is disposed between the latent-image forming member and the charging member to urge them away from each other.

8 Claims, 11 Drawing Sheets

IMAGE FORMING APPARATUS INCLUDING CHARGING UNIT POSITIONING

CROSS-REFERENCE TO RELATED APPLICATIONS

This application is based on and claims priority under 35 USC 119 from Japanese Patent Application No. 2011-249889 filed Nov. 15, 2011.

BACKGROUND (i) Technical Field

The present invention relates to an image forming apparatus.

(ii) Related Art

In an image forming apparatus that forms a latent image on an image carrier and forms a toner image by supplying toner to the latent image, a charging member is used to charge an outer peripheral surface of the image carrier.

Such a charging member includes a charge wire (an example of a discharge electrode) that supplies an electric charge to the image carrier and a grid electrode (an example of a control electrode) that controls the potential of the image carrier. The grid electrode may be curved along the image carrier to increase the charging speed of the image carrier.

SUMMARY

According to an aspect of the invention, there is provided an image forming apparatus including a latent-image forming member, a charging member, a first connecting portion, a second connecting portion, and an urging member. The latent-image forming member includes a cylindrical latent-image carrier and support members that are disposed at both ends of the latent-image carrier, the latent-image carrier being rotatably supported by the support members. The charging member includes a discharge electrode that discharges electricity to supply an electric charge to the latent-image carrier and a control electrode that is disposed between the discharge electrode and the latent-image carrier and controls a potential of the latent-image carrier. The charging member charges an outer peripheral surface of the latent-image carrier to a preset potential. The first connecting portion and the second connecting portion are respectively formed on the latent-image forming member and the charging member and are connected to each other to connect the latent-image forming member and the charging member to each other. The urging member is disposed between the latent-image forming member and the charging member and urges the latent-image forming member and the charging member away from each other.

BRIEF DESCRIPTION OF THE DRAWINGS

An exemplary embodiment of the present invention will be described in detail based on the following figures, wherein.

DETAILED DESCRIPTION

Figure 1:
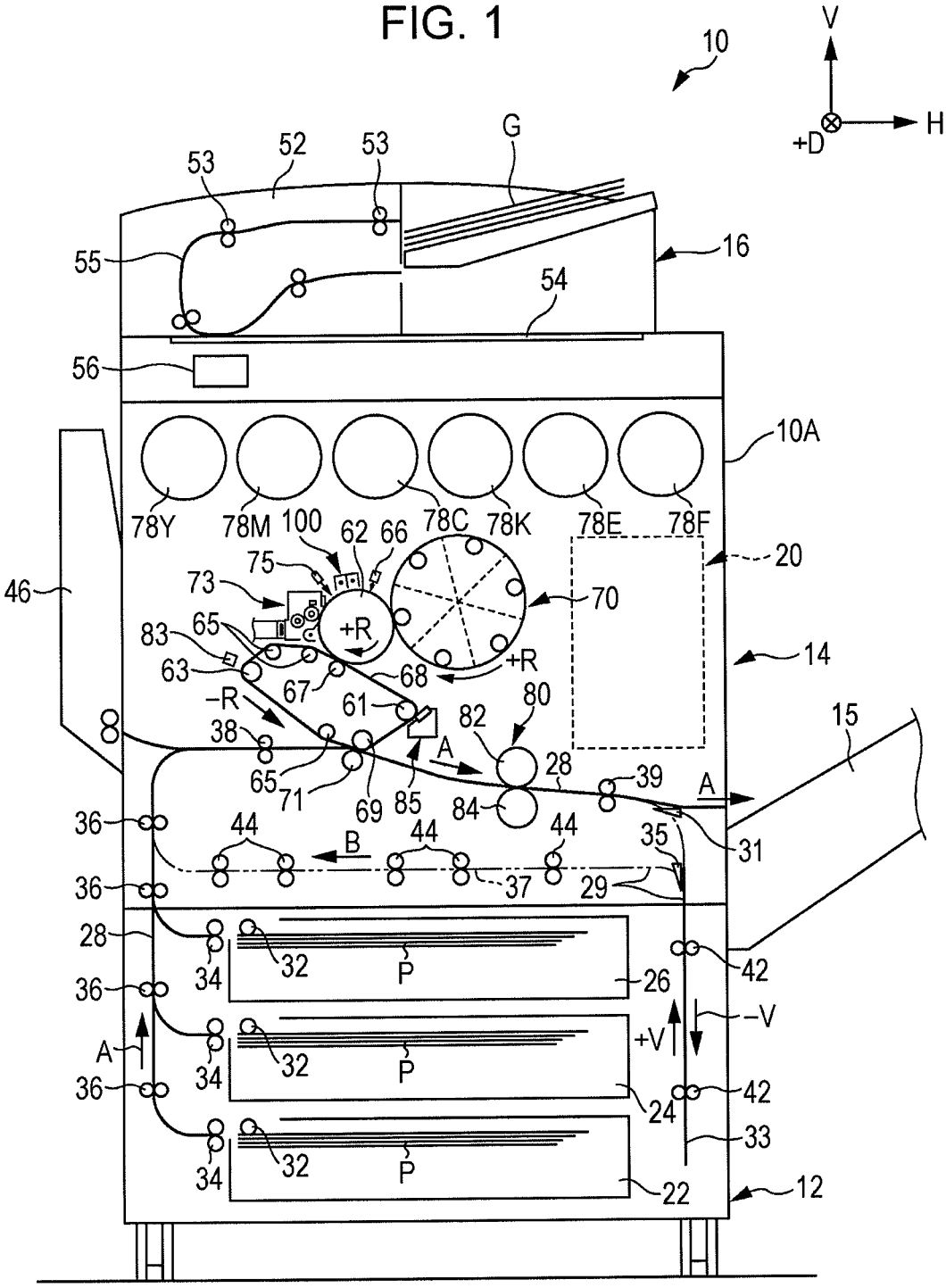
FIG. 1 illustrates the overall structure of an image forming apparatus according to an exemplary embodiment of the present invention.

An exemplary embodiment of the present invention will now be described in detail with reference to the drawings. In the drawings illustrating the exemplary embodiment, identical components are denoted by the same reference numerals, and explanations thereof are thus omitted.

FIG. 1 illustrates an image forming apparatus 10 according to the exemplary embodiment of the present invention.

The image forming apparatus 10 includes, in order from bottom to top in the vertical direction (direction of arrow V), a sheet storing unit 12 in which recording paper P is stored; an image forming unit 14 which is located above the sheet storing unit 12 and forms images on sheets of recording paper P fed from the sheet storing unit 12; and an original-document reading unit 16 which is located above the image forming unit 14 and reads an original document G. The image forming apparatus 10 also includes a controller 20 that is provided in the image forming unit 14 and controls the operation of each part of the image forming apparatus 10. In the following description, the vertical direction, the left-right (horizontal) direction, and the depth (horizontal) direction with respect to an apparatus body 10A of the image forming apparatus 10 will be referred to as the direction of arrow V, the direction of arrow H, and the direction of arrow +D, respectively.

The sheet storing unit 12 includes a first storage unit 22, a second storage unit 24, and a third storage unit 26 in which sheets of recording paper P, which are examples of recording media, having different sizes are stored. Each of the first storage unit 22, the second storage unit 24, and the third storage unit 26 are provided with a feeding roller 32 that feeds the stored sheets of recording paper P to a transport path 28 in the image forming apparatus 10. Pairs of transport rollers 34 and 36 that transport the sheets of recording paper P one at a time are provided along the transport path 28 in an area on the downstream of each feeding roller 32. A pair of positioning rollers 38 are provided on the transport path 28 at a position downstream of the transport rollers 36 in a transporting direction of the sheets of recording paper P. The positioning rollers 38 temporarily stop each sheet of recording paper P and feed the sheet toward a second transfer position, which will be described below, at a predetermined timing.

In the front view of the image forming apparatus 10, an upstream part of the transport path 28 linearly extends in the direction of arrow V from the left side of the sheet storing unit 12 to the lower left part of the image forming unit 14. A downstream part of the transport path 28 extends from the lower left part of the image forming unit 14 to a paper output unit 15 provided on the right side of the image forming unit 14. A duplex-printing transport path 29, which is provided for reversing and transporting each sheet of recording paper P in a duplex printing process, is connected to the transport path 28.

In the front view of the image forming apparatus 10, the duplex-printing transport path 29 includes a first switching member 31, a reversing unit 33, a transporting unit 37, and a second switching member 35. The first switching member 31 switches between the transport path 28 and the duplex-printing transport path 29. The reversing unit 33 extends linearly in the direction of arrow −V (downward in FIG. 1) from a lower right part of the image forming unit 14 along the right side of the sheet storing unit 12. The transporting unit 37 receives the trailing end of each sheet of recording paper P that has been transported to the reversing unit 33 and transports the sheet in the direction of arrow H (leftward in FIG. 1). The second switching member 35 switches between the reversing unit 33 and the transporting unit 37. The reversing unit 33 includes plural pairs of transport rollers 42 that are arranged with intervals therebetween, and the transporting unit 37 includes plural pairs of transport rollers 44 that are arranged with intervals therebetween.

The first switching member 31 has the shape of a triangular prism, and a point end of the first switching member 31 is moved by a driving unit (not shown) to one of the transport path 28 and the duplex-printing transport path 29 so as to change the transporting direction of each sheet of recording paper P. Similarly, the second switching member 35 has the shape of a triangular prism, and a point end of the second switching member 35 is moved by a driving unit (not shown) to one of the reversing unit 33 and the transporting unit 37 so as to change the transporting direction of each sheet of recording paper P. The downstream end of the transporting unit 37 is connected to the transport path 28 by a guiding member (not shown) at a position in front of the transport rollers 36 in the upstream part of the transport path 28. A foldable manual sheet-feeding unit 46 is provided on the left side of the image forming unit 14. The manual sheet-feeding unit 46 is connected to the transport path 28 at a position in front of the positioning rollers 38.

The original-document reading unit 16 includes a document transport device 52 that automatically transports the sheets of the original document G one at a time; a platen glass 54 which is located below the document transport device 52 and on which the sheets of the original document G are placed one at a time; and an original-document reading device 56 that scans each sheet of the original document G while the sheet is being transported by the document transport device 52 or placed on the platen glass 54.

The document transport device 52 includes an automatic transport path 55 along which pairs of transport rollers 53 are arranged. A part of the automatic transport path 55 is arranged such that each sheet of the original document G moves along the top surface of the platen glass 54. The original-document reading device 56 scans each sheet of the original document G that is being transported by the document transport device 52 while being stationary at the left edge of the platen glass 54. Alternatively, the original-document reading device 56 scans each sheet of the original document G placed on the platen glass 54 while moving in the direction of arrow H.

The image forming unit 14 includes a cylindrical photoconductor 62, which is an example of a latent-image carrier, disposed in a central area of the apparatus body 10A. The photoconductor 62 is rotated in the direction of arrow +R (clockwise in FIG. 1) by a driving unit (not shown), and carries an electrostatic latent image formed by irradiation with light. In addition, a scorotron charging unit 100, which is an example of a charging member that charges the surface of the photoconductor 62, is provided above the photoconductor 62 so as to face the outer peripheral surface of the photoconductor 62. The charging unit 100 will be described in detail below.

Figure 2:
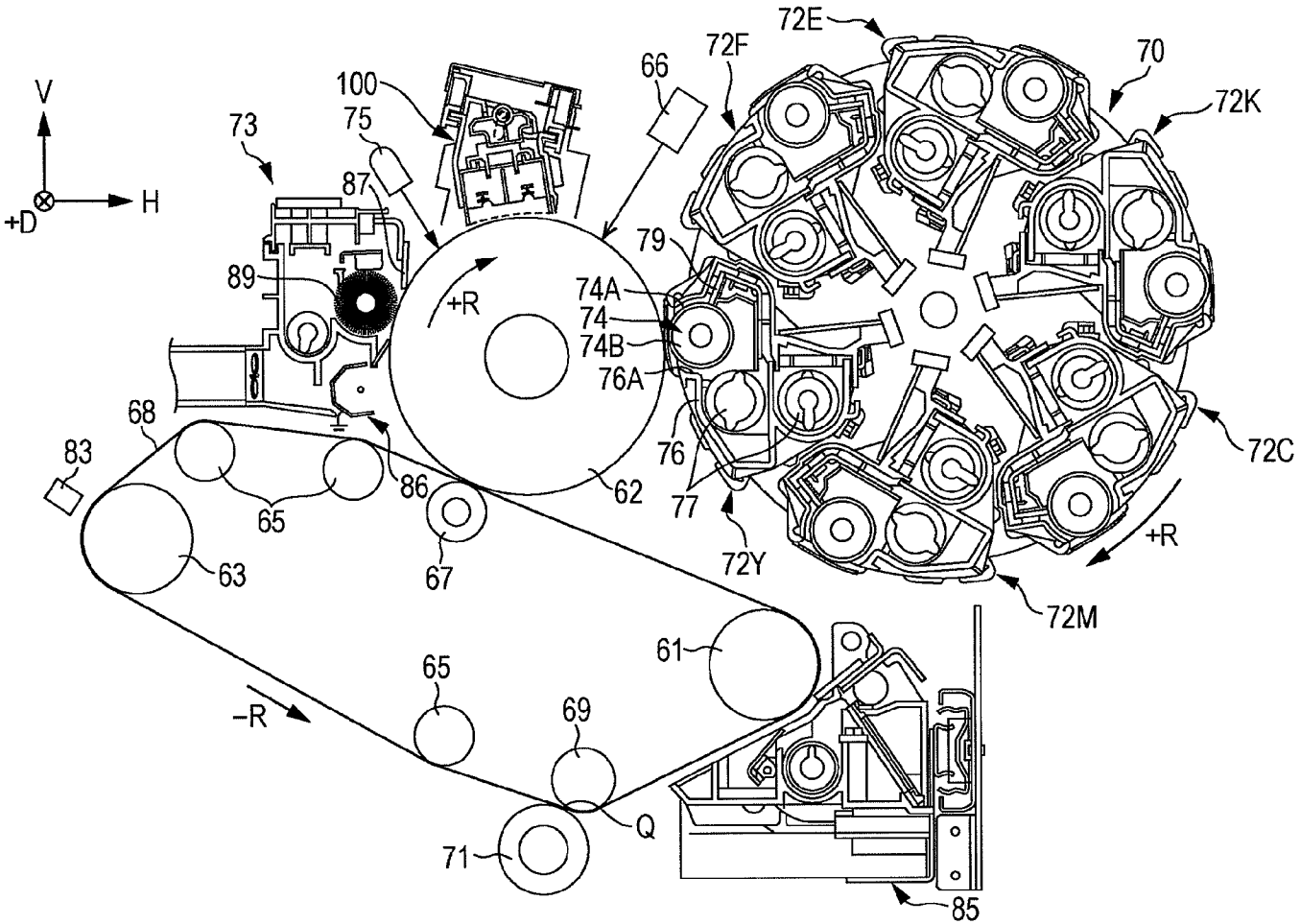
FIG. 2 illustrates the structure of an image forming unit according to the exemplary embodiment of the present invention.

As illustrated in FIG. 2, an exposure device 66 is provided so as to face the outer peripheral surface of the photoconductor 62 at a position downstream of the charging unit 100 in the rotational direction of the photoconductor 62. The exposure device 66 includes a light emitting diode (LED). The outer peripheral surface of the photoconductor 62 that has been charged by the charging unit 100 is irradiated with light (exposed to light) by the exposure device 66 on the basis of an image signal corresponding to each color of toner. Thus, an electrostatic latent image is formed. The exposure device 66 is not limited to those including LEDs. For example, the exposure device 66 may be structured such that the outer peripheral surface of the photoconductor 62 is scanned with a laser beam by using a polygon mirror.

A rotation-switching developing device 70, which is an example of a developing member, is provided downstream of a position where the photoconductor 62 is irradiated with exposure light by the exposure device 66 in the rotational direction of the photoconductor 62. The developing device 70 visualizes the electrostatic latent image on the outer peripheral surface of the photoconductor 62 by developing the electrostatic latent image with toner of each color.

An intermediate transfer belt 68 is provided downstream of the developing device 70 in the rotational direction of the photoconductor 62 and below the photoconductor 62. A toner image formed on the outer peripheral surface of the photoconductor 62 is transferred onto the intermediate transfer belt 68. The intermediate transfer belt 68 is an endless belt, and is wound around a driving roller 61 that is rotated by the controller 20, a tension-applying roller 63 that applies a tension to the intermediate transfer belt 68, plural transport rollers 65 that are in contact with the back surface of the intermediate transfer belt 68 and are rotationally driven, and an auxiliary roller 69 that is in contact with the back surface of the intermediate transfer belt 68 at the second transfer position, which will be described below, and is rotationally driven. The intermediate transfer belt 68 is rotated in the direction of arrow −R (counterclockwise in FIG. 2) when the driving roller 61 is rotated.

A first transfer roller 67 is opposed to the photoconductor 62 with the intermediate transfer belt 68 interposed therebetween. The first transfer roller 67 performs a first transfer process in which the toner image formed on the outer peripheral surface of the photoconductor 62 is transferred onto the intermediate transfer belt 68. The first transfer roller 67 is in contact with the back surface of the intermediate transfer belt 68 at a position downstream of the position where the photoconductor 62 is in contact with the intermediate transfer belt 68 in the moving direction of the intermediate transfer belt 68. The first transfer roller 67 receives electricity from a power source (not shown), so that a potential difference is generated between the first transfer roller 67 and the photoconductor 62, which is grounded. Thus, the first transfer process is carried out in which the toner image on the photoconductor 62 is transferred onto the intermediate transfer belt 68.

A second transfer roller 71, which is an example of a transfer member, is opposed to the auxiliary roller 69 with the intermediate transfer belt 68 interposed therebetween. The second transfer roller 71 performs a second transfer process in which toner images that have been transferred onto the intermediate transfer belt 68 in the first transfer process are transferred onto the sheet of recording paper P. The position between the second transfer roller 71 and the auxiliary roller 69 serves as the second transfer position (position Q in FIG. 2) at which the toner images are transferred onto the sheet of recording paper P. The second transfer roller 71 is in contact with the intermediate transfer belt 68. The second transfer roller 71 receives electricity from a power source (not shown), so that a potential dereference is generated between the second transfer roller 71 and the auxiliary roller 69, which is grounded. Thus, the second transfer process is carried out in which the toner images on the intermediate transfer belt 68 are transferred onto the sheet of recording paper P.

A cleaning device 85 is opposed to the driving roller 61 with the intermediate transfer belt 68 interposed therebetween. The cleaning device 85 collects residual toner that remains on the intermediate transfer belt 68 after the second transfer process. A position detection sensor 83 is opposed to the tension-applying roller 63 at a position outside the intermediate transfer belt 68. The position detection sensor 83 detects a predetermined reference position on the surface of the intermediate transfer belt 68 by detecting a mark (not shown) on the intermediate transfer belt 68. The position detection sensor 83 outputs a position detection signal that serves as a reference for the time to start an image forming process.

A cleaning device 73 is provided downstream of the first transfer roller 67 in the rotational direction of the photoconductor 62. The cleaning device 73 removes residual toner and the like that remain on the surface of the photoconductor 62 instead of being transferred onto the intermediate transfer belt 68 in the first transfer process. The cleaning device 73 collects the residual toner and the like with a cleaning blade 87 and a brush roller 89 (see FIG. 2) that are in contact with the surface of the photoconductor 62.

An erase device 86 (see FIG. 2) is provided upstream of the cleaning device 73 and downstream of the first transfer roller 67 in the rotational direction of the photoconductor 62. The erase device 86 removes the electric charge by irradiating the outer peripheral surface of the photoconductor 62 with light. The erase device 86 removes the electric charge by irradiating the outer peripheral surface of the photoconductor 62 with light before the residual toner and the like are collected by the cleaning device 73. Accordingly, the electrostatic adhesive force is reduced and the collection rate of the residual toner and the like is increased. An erase lamp 75 for removing the electric charge after the collection of the residual toner and the like may be provided downstream of the cleaning device 73 and upstream of the charging unit 100.

The second transfer position at which the toner images are transferred onto the sheet of recording paper P by the second transfer roller 71 is at an intermediate position of the above-described transport path 28. A fixing device 80 is provided on the transport path 28 at a position downstream of the second transfer roller 71 in the transporting direction of the sheet of recording paper P (direction of arrow A). The fixing device 80 fixes the toner images that have been transferred onto the sheet of recording paper P by the second transfer roller 71.

The fixing device 80 includes a heating roller 82 and a pressing roller 84. The heating roller 82 is disposed at the side of the sheet of recording paper P at which the toner images are formed (upper side), and includes a heat source which generates heat when electricity is supplied thereto. The pressing roller 84 is positioned below the heating roller 82, and presses the sheet of recording paper P against the outer peripheral surface of the heating roller 82. Transport rollers 39 that transport the sheet of recording paper P to the paper output unit 15 or the reversing unit 33 are provided on the transport path 28 at a position downstream of the fixing device 80 in the transporting direction of the sheet of recording paper P.

Toner cartridges 78Y, 78M, 78C, 78K, 78E, and 78F that respectively contain yellow (Y) toner, magenta (M) toner, cyan (C) toner, black (K) toner, toner of a first specific color (E), and toner of a second specific color (F) are arranged in the direction of arrow H in a replaceable manner in an area below the original-document reading device 56 and above the developing device 70. The first and second specific colors E and F may be selected from specific colors (including transparent) other than yellow, magenta, cyan, and black. Alternatively, the first and second specific colors E and F are not selected.

When the first and second specific colors E and F are selected, the developing device 70 performs the image forming process using six colors, which are Y, M, C, K, E, and F. When the first and second specific colors E and F are not selected, the developing device 70 performs the image forming process using four colors, which are Y, M, C, and K. In the present exemplary embodiment, the case in which the image forming process is performed using the four colors, which are Y, M, C, and K, and the first and second specific colors E and F are not used will be described as an example. However, as another example, the image forming process may be performed using five colors, which are Y, M, C, K, and one of the first and second specific colors E and F.

As illustrated in FIG. 2, the developing device 70 includes developing units 72Y, 72M, 72C, 72K, 72E, and 72F corresponding to the respective colors, which are yellow (Y), magenta (M), cyan (C), black (K), the first specific color (E), and the second specific color (F), respectively. The developing units 72Y, 72M, 72C, 72K, 72E, and 72F are arranged in that order in a circumferential direction (counterclockwise). The developing device 70 is rotated by a motor (not shown), which is an example of a rotating unit, in steps of 60°. Accordingly, one of the developing units 72Y, 72M, 72C, 72K, 72E, and 72F that is to perform a developing process is selectively opposed to the outer peripheral surface of the photoconductor 62. The developing units 72Y, 72M, 72C, 72K, 72E, and 72F have similar structures. Therefore, only the developing unit 72Y will be described, and explanations of the other developing units 72M, 72C, 72K, 72E, and 72F will be omitted.

The developing unit 72Y includes a casing member 76, which serves as a base body. The casing member 76 is filled with developer (not shown) including toner and carrier. The developer is supplied from the toner cartridge 78Y (see FIG. 1) through a toner supply channel (not shown). The casing member 76 has a rectangular opening 76A that is opposed to the outer peripheral surface of the photoconductor 62. A developing roller 74 is disposed in the opening 76A so as to face the outer peripheral surface of the photoconductor 62. A plate-shaped regulating member 79, which regulates the thickness of a developer layer, is provided along the longitudinal direction of the opening 76A at a position near the opening 76A in the casing member 76.

The developing roller 74 includes a rotatable cylindrical developing sleeve 74A and a magnetic unit 74B fixed to the inner surface of the developing sleeve 74A and including plural magnetic poles. A magnetic brush made of the developer (carrier) is formed as the developing sleeve 74A is rotated, and the thickness of the magnetic brush is regulated by the regulating member 79. Thus, the developer layer is formed on the outer peripheral surface of the developing sleeve 74A. The developer layer on the outer peripheral surface of the developing sleeve 74A is moved to the position where the developing sleeve 74A faces the photoconductor 62. Accordingly, the toner adheres to the latent image (electrostatic latent image) formed on the outer peripheral surface of the photoconductor 62. Thus, the latent image is developed.

Two helical transport rollers 77 are rotatably arranged in parallel to each other in the casing member 76. The two transport rollers 77 rotate so as to circulate the developer contained in the casing member 76 in the axial direction of the developing roller 74 (longitudinal direction of the developing unit 72Y). Six developing rollers 74 are included in the respective developing units 72Y, 72M, 72C, 72K, 72E, and 72F, and are arranged along the circumferential direction so as to be separated form each other by 60° in terms of the central angle. When the developing units 72 are switched, the developing roller 74 in the newly selected developing unit 72 is caused to face the outer peripheral surface of the photoconductor 62.

An image forming process performed by the image forming apparatus 10 will now be described.

Referring to FIG. 1, when the image forming apparatus 10 is activated, image data of respective colors, which are yellow (Y), magenta (M), cyan (C), black (K), the first specific color (E), and the second specific color (F), are successively output to the exposure device 66 from an image processing device (not shown) or an external device. At this time, the developing device 70 is held such that the developing unit 72Y, for example, is opposed to the outer peripheral surface of the photoconductor 62 (see FIG. 2).

Next, electricity is applied to charge wires 102A and 102B (see FIG. 3), which are examples of a discharge electrode, in the charging unit 100, so that a potential difference is generated between the photoconductor 62, which is grounded, and the charge wires 102A and 102B. Accordingly, corona discharge occurs and the outer peripheral surface of the photoconductor 62 is charged. At this time, a bias voltage is applied to the grid electrode 104 (see FIG. 3), which is an example of a control electrode, so that the charge potential (discharge current) of the photoconductor 62 is within an allowable range.

The exposure device 66 emits light in accordance with the image data, and the outer peripheral surface of the photoconductor 62, which has been charged by the charging unit 100, is exposed to the emitted light. Accordingly, an electrostatic latent image corresponding to the yellow image data is formed on the surface of the photoconductor 62. The electrostatic latent image formed on the surface of the photoconductor 62 is developed as a yellow toner image by the developing unit 72Y. The yellow toner image on the surface of the photoconductor 62 is transferred onto the intermediate transfer belt 68 by the first transfer roller 67.

Then, referring to FIG. 2, the developing device 70 is rotated by 60° in the direction of arrow +R, so that the developing unit 72M is opposed to the surface of the photoconductor 62. Then, the charging process, the exposure process, and the developing process are performed so that a magenta toner image is formed on the surface of the photoconductor 62. The magenta toner image is transferred onto the yellow toner image on the intermediate transfer belt 68 by the first transfer roller 67. Similarly, cyan (C) and black (K) toner images are successively transferred onto the intermediate transfer belt 68, and toner images of the first specific color (E) and the second specific color (F) are additionally transferred onto the intermediate transfer belt 68 depending on the color setting.

A sheet of recording paper P is fed from the sheet storing unit 12 and transported along the transport path 28, as illustrated in FIG. 1. Then, the sheet is transported by the positioning rollers 38 to the second transfer position (position Q in FIG. 2) in synchronization with the time at which the toner images are transferred onto the intermediate transfer belt 68 in a superimposed manner. Then, the second transfer process is performed in which the toner images that have been transferred onto the intermediate transfer belt 68 in a superimposed manner are transferred by the second transfer roller 71 onto the sheet of recording paper P that has been transported to the second transfer position.

The sheet of recording paper P onto which the toner images have been transferred is transported toward the fixing device 80 in the direction of arrow A (rightward in FIG. 1). The fixing device 80 fixes the toner images to the sheet of recording paper P by applying heat and pressure thereto with the heating roller 82 and the pressing roller 84. The sheet of recording paper P to which the toner images are fixed is ejected to, for example, the paper output unit 15.

When images are to be formed on both sides of the sheet of recording paper P, the following process is performed. That is, after the toner images on the front surface of the sheet of recording paper P are fixed by the fixing device 80, the sheet is transported to the reversing unit 33 in the direction of arrow −V. Then, the sheet of recording paper P is transported in the direction of arrow +V, so that the leading and trailing edges of the sheet of recording paper P are reversed. Then, the sheet of recording paper P is transported along the duplex-printing transport path 29 in the direction of arrow B (leftward in FIG. 1), and is inserted into the transport path 28. Then, the back surface of the sheet of recording paper P is subjected to the image forming process and the fixing process.

Next, the charging unit 100 and an attachment structure for the charging unit 100 will be described.

Figure 3:
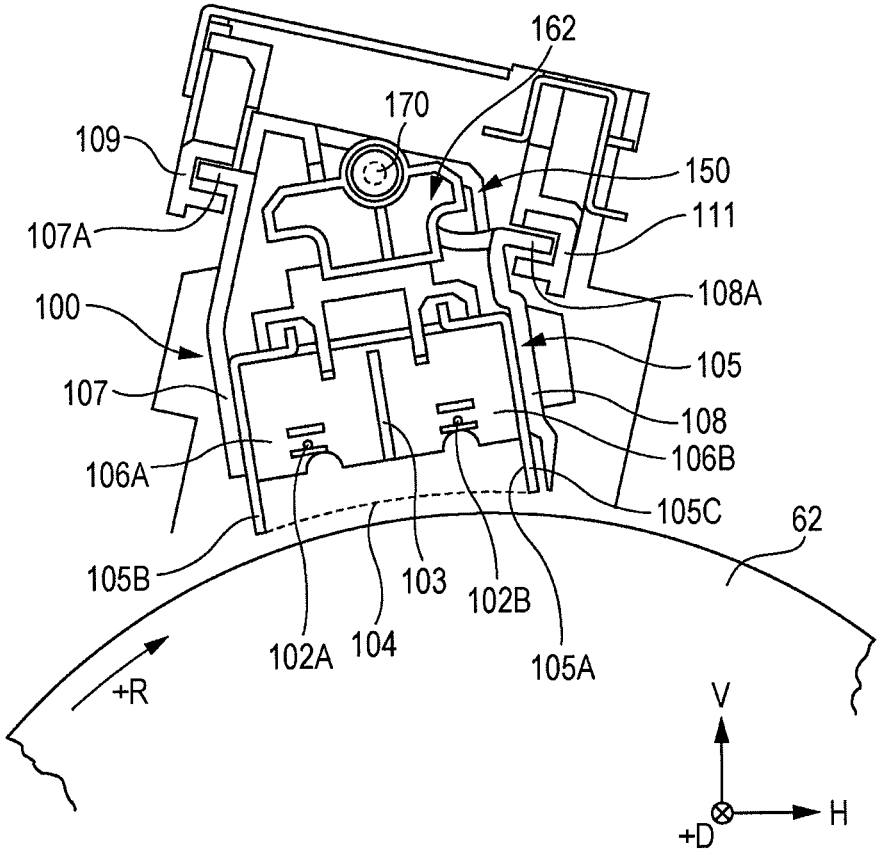
FIG. 3 illustrates the structure of an area around a photoconductor according to the exemplary embodiment of the present invention.

As illustrated in FIG. 3, the charging unit 100 includes a shielding member 105 that is angular U-shaped in the H-V plane (cross section). The inner space of the shielding member 105 is divided into chambers 106A and 106B by a partition plate 103 that stands so as to extend in the direction of arrow +D. The chamber 106A is at the upstream side in the direction of arrow +R, and the chamber 106B is at the downstream side in the direction of arrow +R. The shielding member 105 has, for example, an opening 105A that faces the outer peripheral surface of the photoconductor 62.

The charge wire 102A, which is an example of a discharge electrode, is disposed in the chamber 106A so as to extend in the direction of arrow +D. Similarly, the charge wire 102B, which is also an example of a discharge electrode, is disposed in the chamber 106B so as to extend in the direction of arrow +D. The grid electrode 104, which is an example of a control electrode, is attached to the shielding member 105 so as to cover the opening 105A. The grid electrode 104 is disposed between the outer peripheral surface of the photoconductor 62 and the charge wires 102A and 102B in the H-V plane.

Cover members 107 and 108 that stand in the direction of arrow V are attached to outer surfaces of a pair of side walls 105B and 105C of the shielding member 105 that face each other in the direction of arrow H. The cover member 107 is bent outward (leftward in FIG. 3) into the shape of the letter 'L' at the top end thereof, and thus a plate-shaped guide member 107A is formed. The cover member 108 is bent outward (rightward in FIG. 3) into the shape of the letter 'L' at the top end thereof, and thus a plate-shaped guide member 108A is formed. The guide members 107A and 108A are guided in the direction of arrow +D and retained (restrained from being moved) in the directions shown by arrows H and V by guide rails 109 and 111. Accordingly, the charging unit 100 is disposed so as to face the outer peripheral surface of the photoconductor 62.

Figure 4:
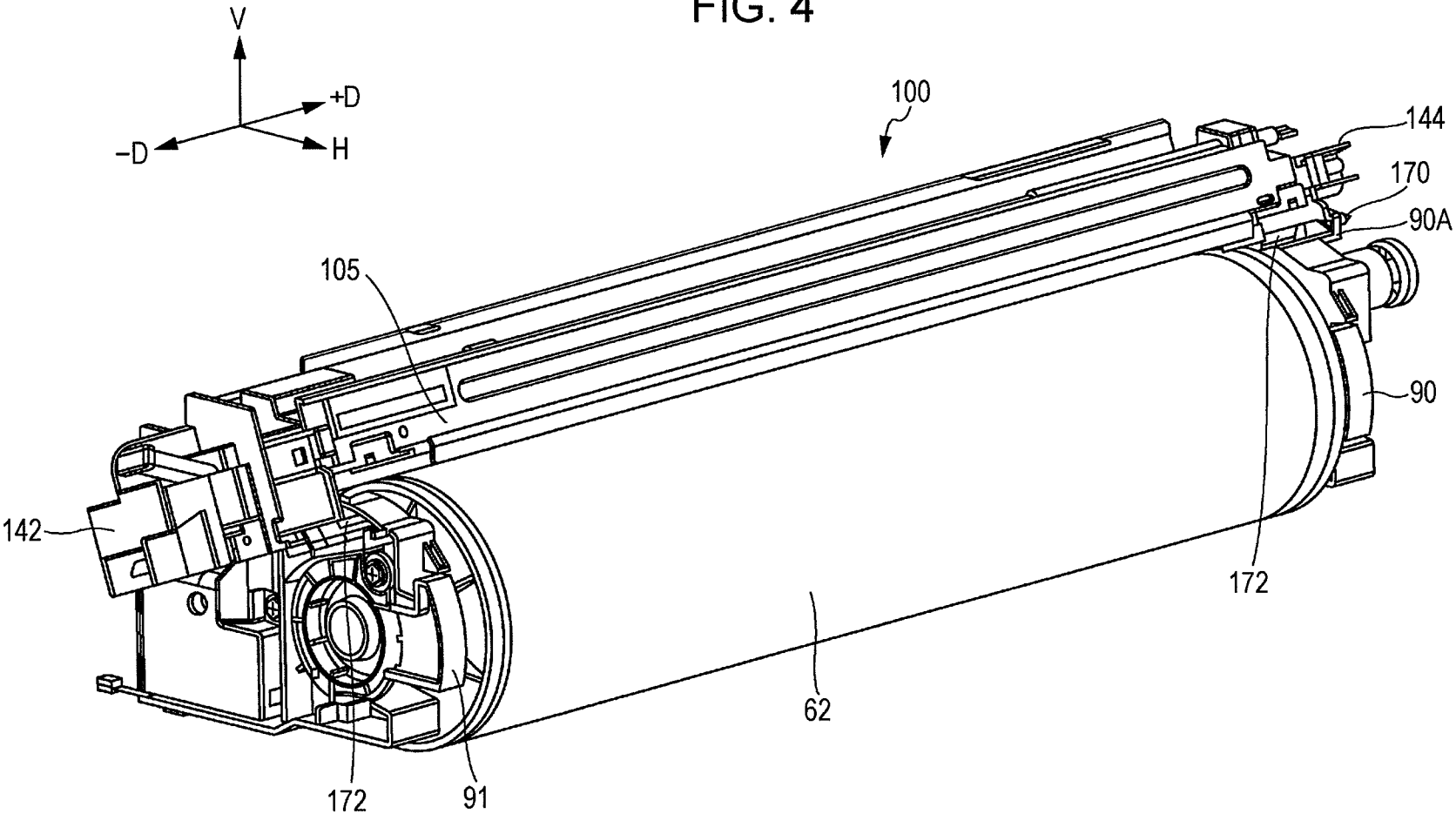
FIG. 4 is a perspective view illustrating the photoconductor and the charging unit according to the exemplary embodiment of the present invention.

Referring to FIG. 4, housings 90 and 91 that support the photoconductor 62 in a rotatable manner are provided at both ends of the photoconductor 62 in the axial direction. The photoconductor 62 and the housings 90 and 91 form a latent-image forming member.

As illustrated in FIG. 4, attachment members 142 and 144 are attached to the shielding member 105 of the charging unit 100 at the ends thereof in the directions of arrows +D and −D. The grid electrode 104 is attached to the attachment members 142 and 144. The attachment member 142 is provided at the end in the direction of arrow −D, and the attachment member 144 is provided at the end in the direction of arrow +D.

Figure 5:
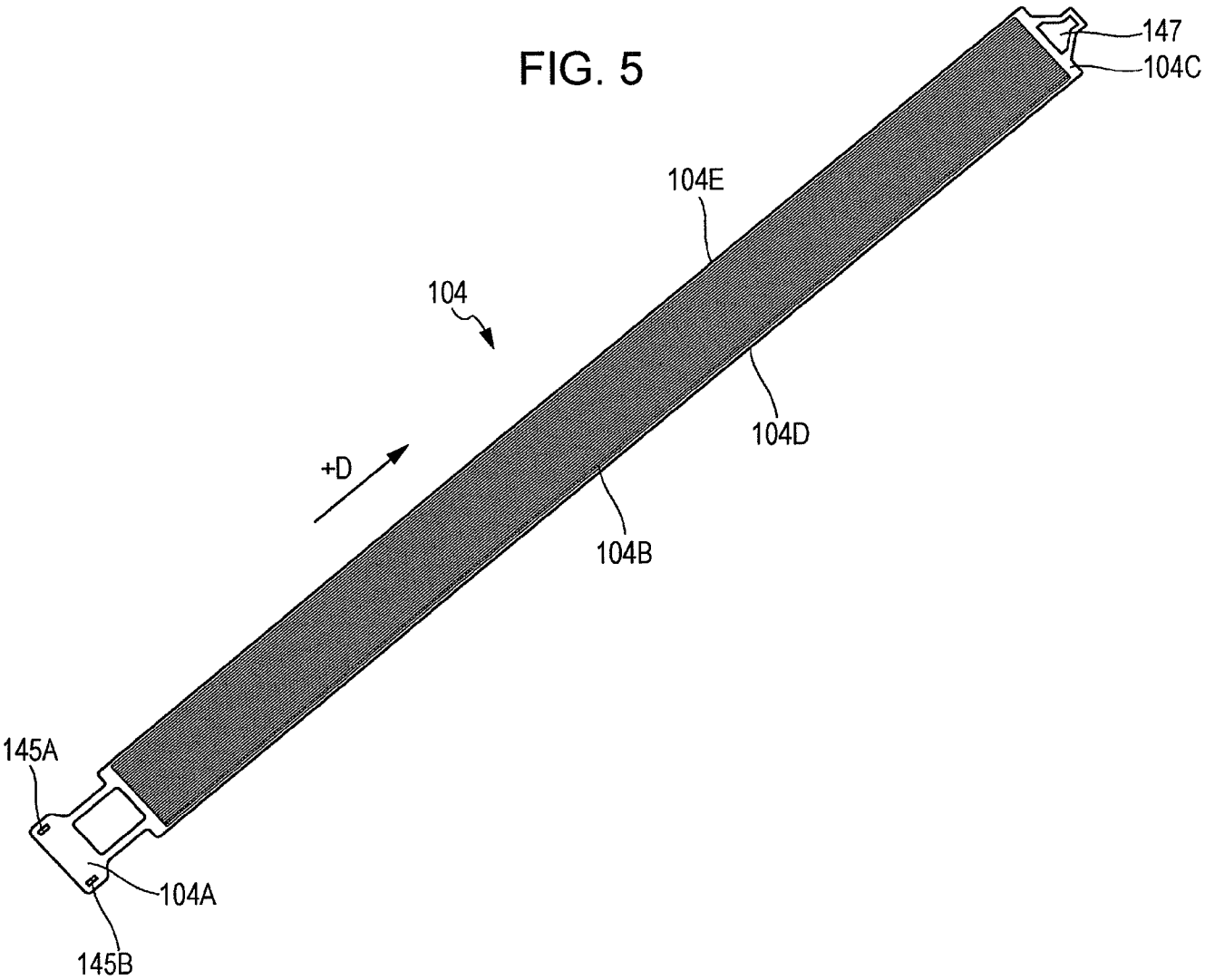
FIG. 5 is a perspective view illustrating the shape of a grid electrode according to the exemplary embodiment of the present invention.
Figure 6:
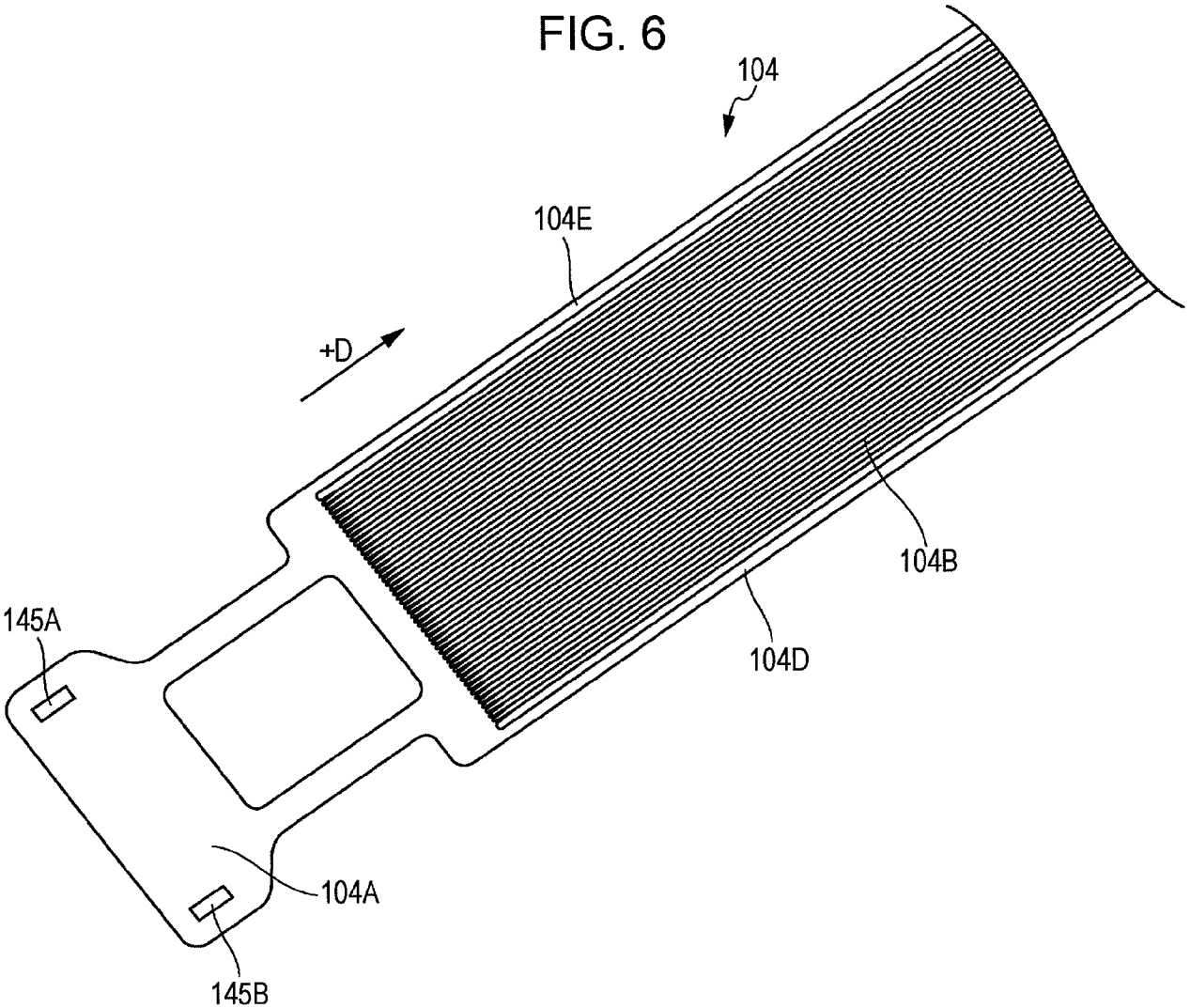
FIG. 6 is a perspective view illustrating the shape of a portion of the grid electrode at a first end in a longitudinal direction according to the exemplary embodiment of the present invention.
Figure 7:
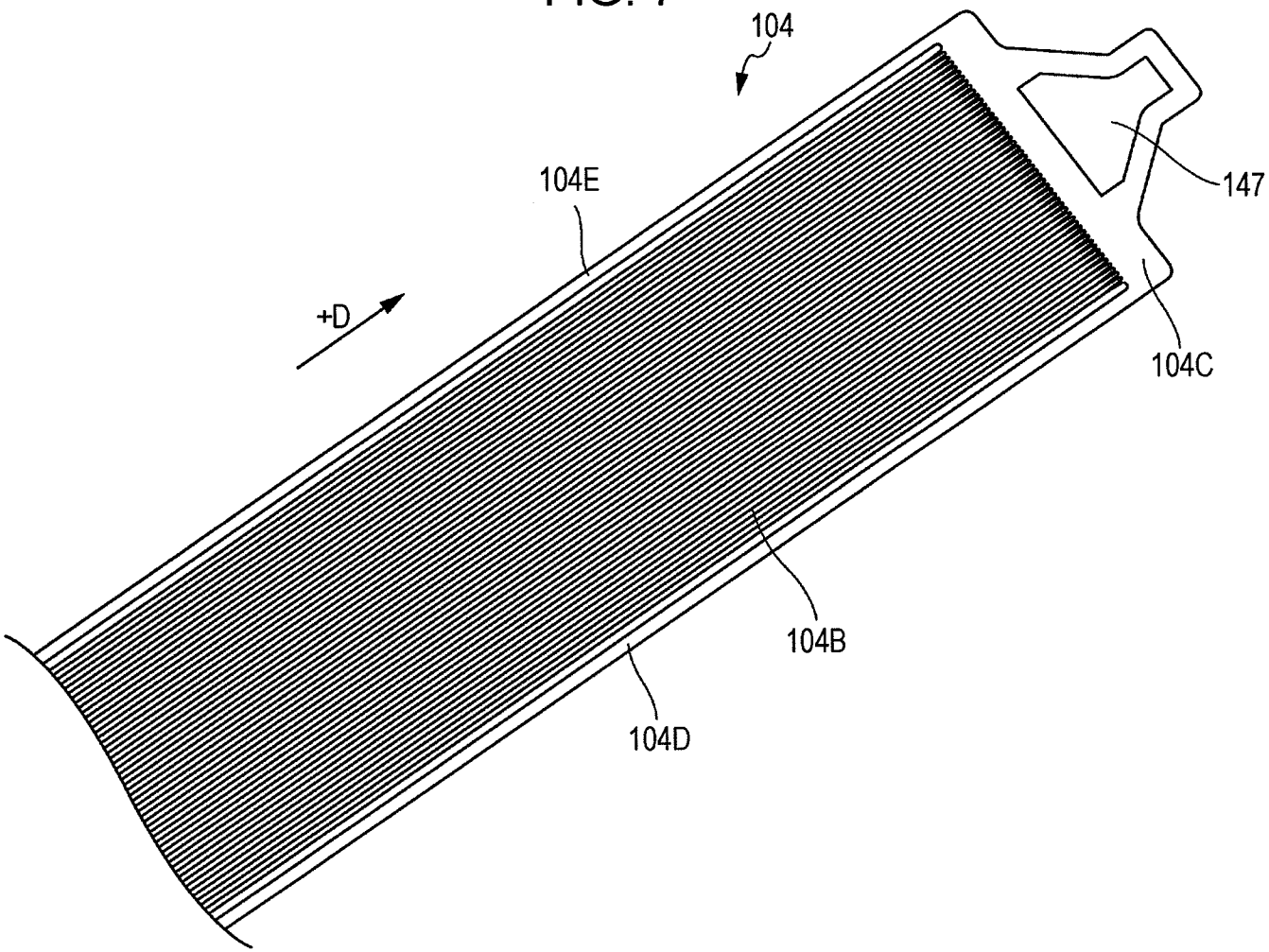
FIG. 7 is a perspective view illustrating the shape of a portion of the grid electrode at a second end in the longitudinal direction according to the exemplary embodiment of the present invention.

Referring to FIGS. 5 to 7, the grid electrode 104 has a rectangular shape in plan view, and includes, in order from one end to the other in the longitudinal direction, an attachment portion 104A, an electrode portion 104B, and an attachment portion 104C, which are integrated with each other.

In the state in which the grid electrode 104 is attached to the charging unit 100, the grid electrode 104 is curved in cross section along the width direction thereof. More specifically, the attachment portion 104A, the electrode portion 104B, and the attachment portion 104C of the grid electrode 104 are convexly curved toward the charge wires 102A and 102B (see FIG. 3). The curvature of the attachment portion 104A, the electrode portion 104B, and the attachment portion 104C is set such that a distance d to the outer peripheral surface of the photoconductor 62 is constant along the circumferential direction of the photoconductor 62. In other words, the above-mentioned portions are curved along the outer peripheral surface of the photoconductor 62.

The electrode portion 104B of the grid electrode 104 has a mesh pattern including plural hexagonal holes (not shown). Frame portions 104D and 104E for increasing the rigidity are formed at the sides of the electrode portion 104B in the width direction. The electrode portion 104B is surrounded by the frame portion 104D, the attachment portion 104A, the frame portion 104E, and the attachment portion 104C.

As illustrated FIGS. 5 and 6, the attachment portion 104A of the grid electrode 104 has attachment holes 145A and 145B, which are through holes that extend in the thickness direction. The attachment holes 145A and 145B have a rectangular shape and are formed with an interval therebetween in the width direction at a first end of the grid electrode 104.

As illustrated in FIGS. 5 and 7, the attachment portion 104C has an attachment hole 147, which is a through hole that extends in the thickness direction. The attachment portion 104C has a substantially triangular shape and is formed at a second end of the grid electrode 104.

Figure 8:
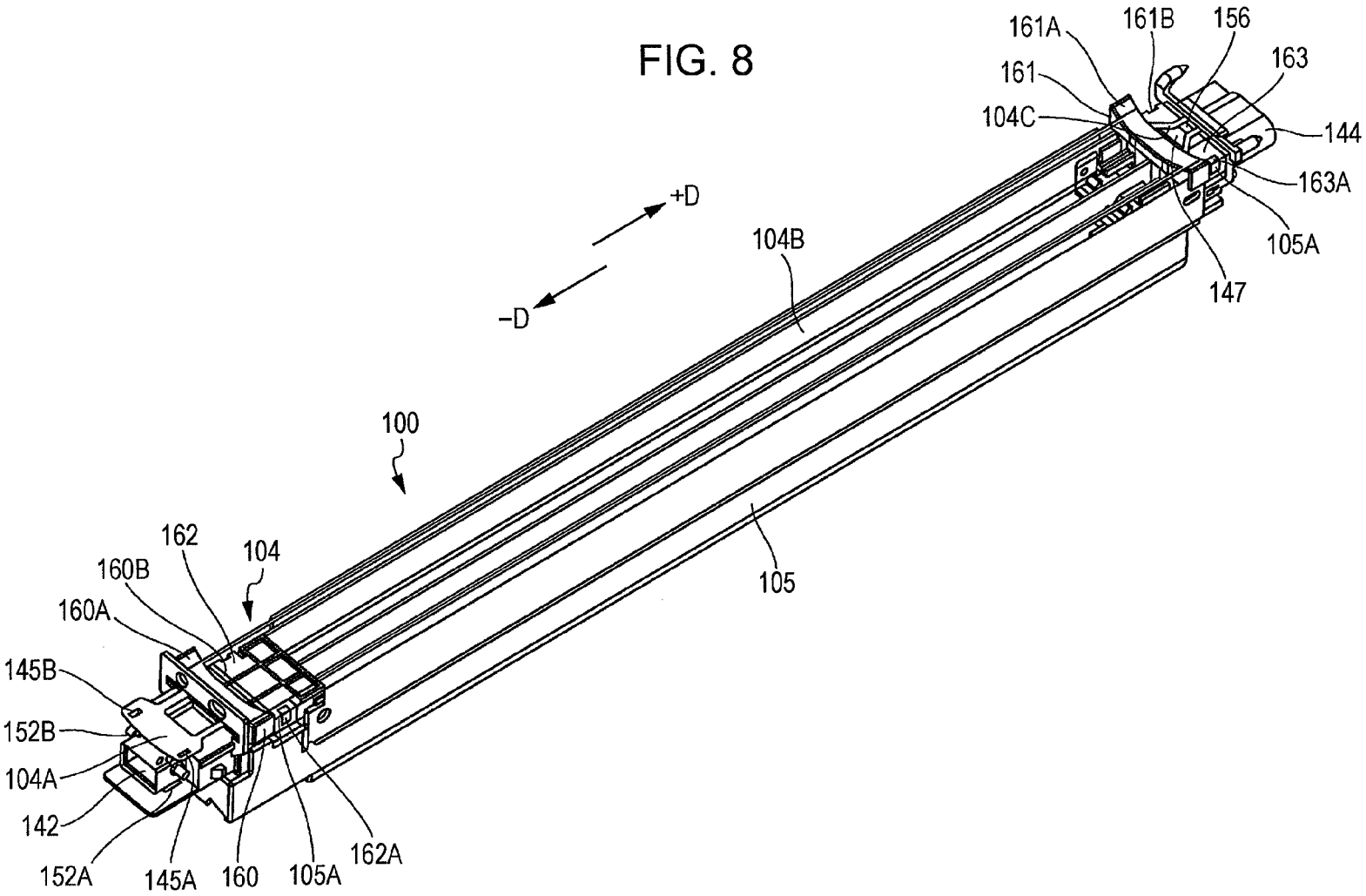
FIG. 8 is a perspective view illustrating the charging unit according to the exemplary embodiment of the present invention.

As illustrated in FIG. 8, the attachment member 142 is provided with spring members 152A and 152B that urge the grid electrode 104 in the direction of arrow −D. The spring members 152A and 152B may be, for example, torsion springs, and are fixed to the attachment member 142 at one end thereof and hooked to the edges of the attachment holes 145A and 145B at the other end thereof, the attachment holes 145A and 145B being formed in the grid electrode 104 at the first end thereof in the longitudinal direction.

A hook portion 156 used to secure the second end of the grid electrode 104 in the longitudinal direction is provided at the bottom of the attachment member 144. The hook portion 156 is bent in the direction of arrow +D, and is hooked to an end of the attachment hole 147 formed in the grid electrode 104.

The grid electrode 104 is attached to the charging unit 100 by pulling the grid electrode 104 in the direction of arrow +D while the spring members 152A and 152B are respectively hooked to the attachment holes 145A and 145B in the grid electrode 104, and hooking the hook portion 156 to the attachment hole 147.

Referring to FIG. 8, the attachment members 142 and 144, which are attached to the charging unit 100, are respectively provided with support members 160 and 161. The support members 160 and 161 respectively include support surfaces 160A and 161A on which the grid electrode 104 is supported, and cover the inside of the shielding member 105. The support surfaces 160A and 161A are concave surfaces that face downward, and support both ends of the grid electrode 104 in the longitudinal direction at the side at which the charge wires 102A and 102B are provided. Thus, the grid electrode 104 is curved along the support surfaces 160A and 161A so as to be concentric with the photoconductor 62.

The support members 160 and 161 are fixed to the shielding member 105 by fixing members 162 and 163, respectively. The fixing members 162 and 163 respectively extend over the support members 160 and 161 in the width direction and have fitting holes 162A and 163A in which locking pawls 105A formed on the shielding member 105 are fitted. Accordingly, force that presses the support members 160 and 161 against the shielding member 105 is generated by the fixing members 162 and 163, respectively, and the support members 160 and 161 are assembled to the shielding member 105 without leaving gaps therebetween.

The support members 160 and 161 have a stepped shape and include fixing surfaces 160B and 161B formed at positions closer to the shielding member 105 than the support surfaces 160A and 161A. In other words, the fixing surfaces 160B and 161B are recessed upward from the support surfaces 160A and 161A when viewed from below. The support members 160 and 161 are fixed to the shielding member 105 by the fixing members 162 and 163, respectively, at the fixing surfaces 160B and 161B thereof, so that the grid electrode 104 does not interfere with the fixing members 162 and 163. The above-described hook portion 156 is formed on the fixing member 163 so as to project downward, and is hooked to the end of the attachment hole 147 in the grid electrode 104 at the same position as the support surface 161A or at a position closer to the shielding member 105 than the support surface 161A.

The spring members 152A and 152B are torsion springs for applying tension to the grid electrode 104. The spring members 152A and 152B are hooked to the first end of the grid electrode 104 in the longitudinal direction. Accordingly, the direction in which the torsion of the spring members 152A and 152B is applied corresponds to the direction in which the support member 160 is pressed against the shielding member 105 by the grid electrode 104. As a result, the first end of the curved grid electrode 104 in the longitudinal direction is pressed against the support surface 160A of the support member 160, and the support member 160 is in tight contact with the shielding member 105.

In addition, the hook portion 156 is formed on the fixing member 163 and is hooked to the end of the attachment hole 147 in the grid electrode 104 at the same position as the support surface 161A or at a position closer to the shielding member 105 than the support surface 161A, as described above. Accordingly, the second end of the curved grid electrode 104 in the longitudinal direction is pressed against the support surface 161A of the support member 161. Since the fixing member 163 (or the hook portion 156 formed thereon) is hooked to the first end of the grid electrode 104, the tension applied to the grid electrode 104 is used as the force for pressing the support member 161 against the shielding member 105.

Figure 9:
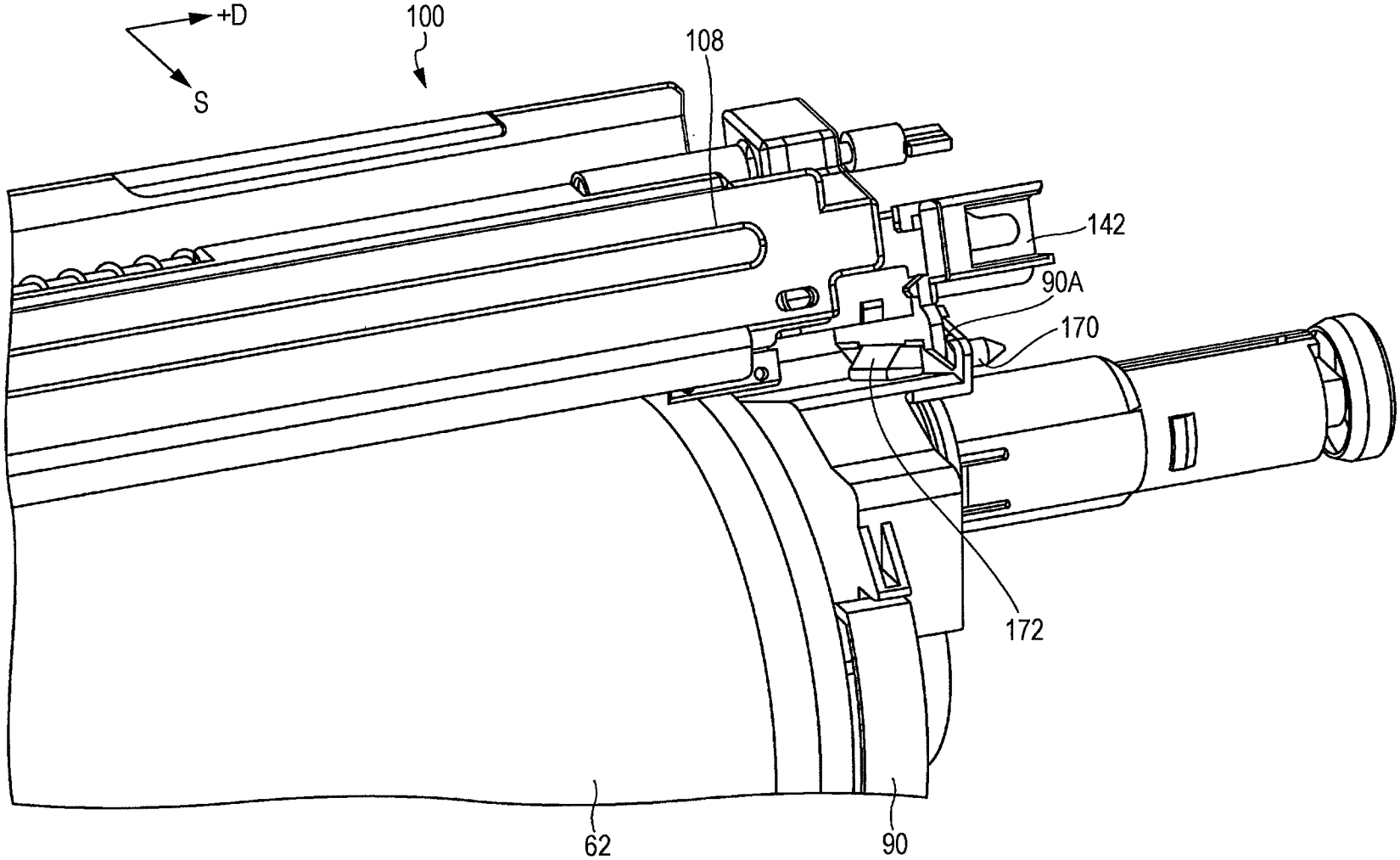
FIG. 9 is a perspective view illustrating the main part of the photoconductor and the charging unit at one end thereof according to the exemplary embodiment of the present invention.
Figure 10:
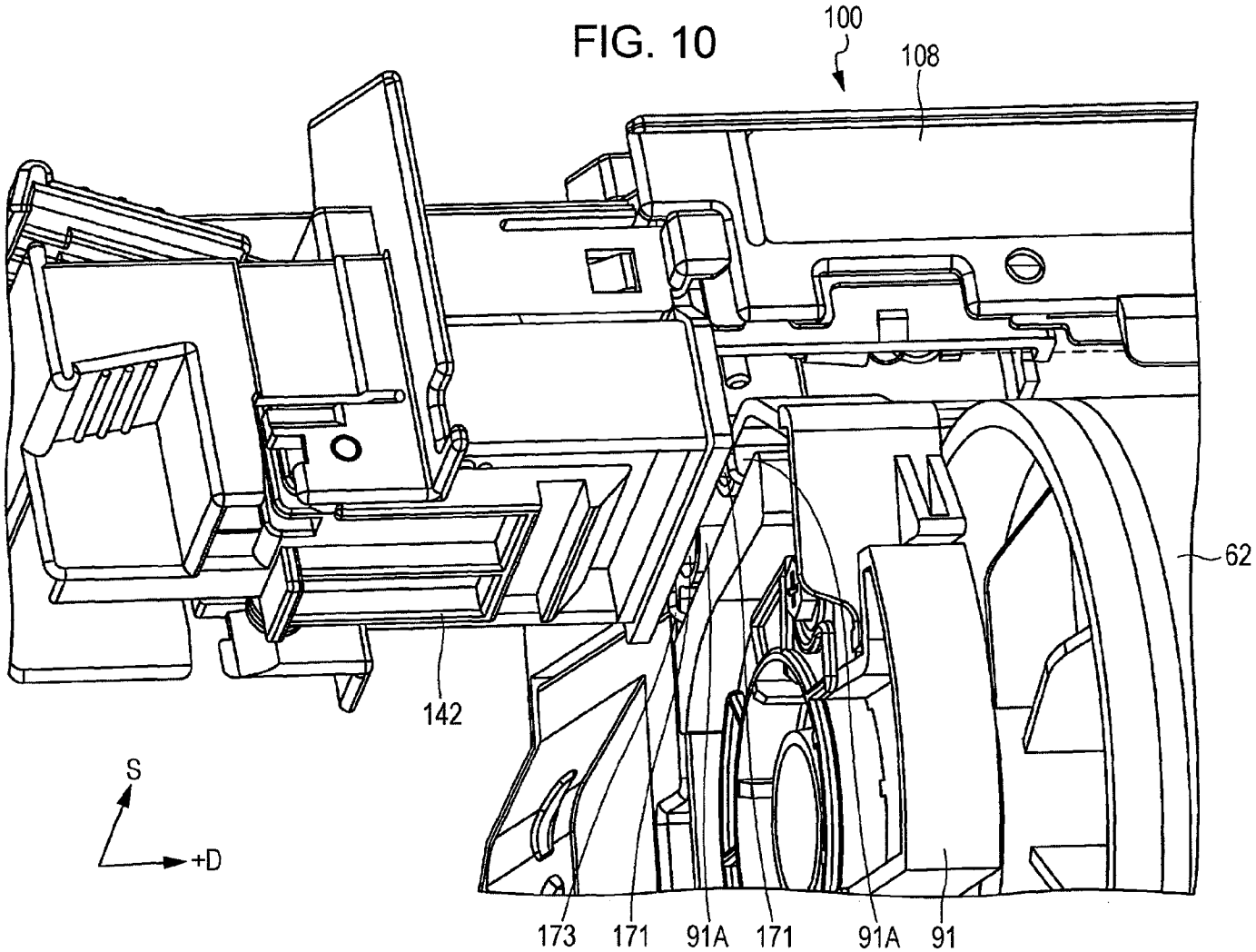
FIG. 10 is a perspective view illustrating the main part of the photoconductor and the charging unit at the other end thereof according to the exemplary embodiment of the present invention.
Figure 11:
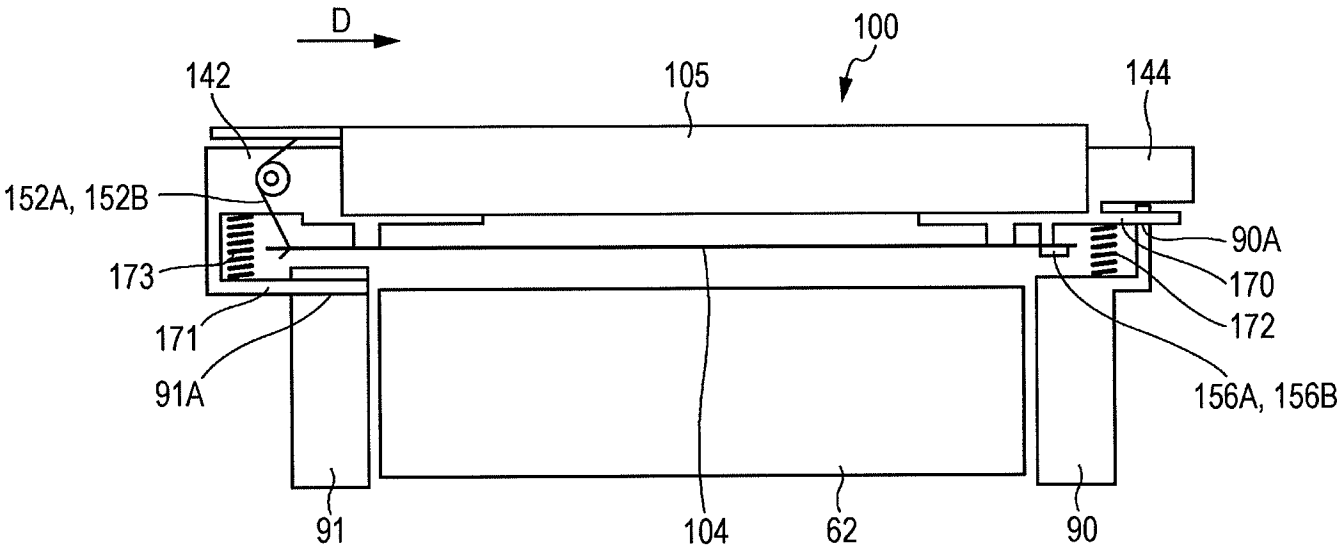
FIG. 11 illustrates the relationship between a latent-image forming member and the charging unit according to the exemplary embodiment of the present invention.

Referring to FIGS. 9 to 11, projecting portions 170 and 171 (examples of a charging-member connecting portion) that extend in the longitudinal direction (direction of arrow +D in this example) are formed at both ends of the charging unit 100 in the longitudinal direction in a lower section of the charging unit 100. More specifically, as illustrated in FIGS. 9 and 11, two projecting portions 170 are formed at a position corresponding to the hosing 90, which is one of the housings that rotatably support the photoconductor 62. The projecting portions 170 are spaced from each other in the direction of arrow S and have narrowed ends. In addition, as illustrated in FIGS. 10 and 11, two projecting portions 171 are formed at a position corresponding to the other housing 91. The projecting portions 171 are spaced from each other in the direction of arrow S and have narrowed ends. One of the projecting portions 170 that are formed at the position corresponding to the housing 90 is positioned behind a component and is therefore not drawn in FIG. 9.

The housings 90 and 91 have insertion holes 90A and 91A (examples of a first connecting portion provided on the latent-image forming member) in which the projecting portions 170 and 171 are inserted.

The projecting portions 170 and 171 are inserted into the insertion holes 90A and 91A by sliding the charging unit 100 in the longitudinal direction. Thus, the charging unit 100 is connected to the latent-image forming member.

In addition, spring members 172 and 173 (examples of an urging member) that urge the charging unit 100 and the latent-image forming member away from each other are provided between the charging unit 100 and the latent-image forming member. The spring members 172 and 173 are disposed at positions corresponding to the above-described projecting portions 170 and 171 and the insertion holes 90A and 91A.

The spring members 172 are leaf springs formed by bending metal plates, as illustrated in FIG. 9. The spring members 173 are torsion springs formed by winding metal wires.

In the image forming apparatus 10 having the above-described structure, the projecting portions 170 and 171 formed on the charging unit 100 are respectively inserted and fitted into the insertion holes 90A and 91A formed in the housings 90 and 91. Thus, the charging unit 100 is connected to the latent-image forming member.

The charging unit 100 and the latent-image forming member, which are connected to each other, are urged away from each other by the spring members 172 and 173, which are disposed between the charging unit 100 and the latent-image forming member.

Accordingly, the gaps formed when the projecting portions 170 and 171 are fitted into the insertion holes 90A and 91A, respectively, are forcedly biased by the spring members 172 and 173. In other words, the projecting portions 170 and 171 are prevented from moving freely by being pressed against predetermined parts of the insertion holes 90A and 91A. As a result, the distance between the charging unit 100 and the latent-image forming member is stabilized, and the photoconductor 62 and the grid electrode 104 are accurately positioned with the distance d therebetween.

The projecting portions 170 and 171, the insertion holes 90A and 91A, and the spring members 172 and 173 are provided at two positions at each end of the charging unit 100 in the longitudinal direction. Therefore, the charging unit 100 and the latent-image forming member are urged away from each other by the spring members 172 and 173 at positions near the positions where the projecting portions 170 and 171 are fitted in the insertion holes 90A and 91A, respectively. Accordingly, the urging force of the spring members 172 and 173 is applied with a good balance to the part in which the projecting portions 170 are fitted in the insertion holes 90A and the part in which the projecting portions 171 are fitted in the insertion holes 91A. As a result, the distance between the charging unit 100 and the latent-image forming member is further stabilized.

In the case where the grid electrode is flat, when the grid electrode provided on the charging unit 100 is pressed against a component formed on the latent-image forming member, the grid electrode and the photoconductor are accurately positioned by the tension of the grid electrode.

However, in the case where the grid electrode is curved as in the present exemplary embodiment, if the grid electrode is pressed against a component formed on the latent-image forming member, the curved shape of the grid electrode will be deformed.

In addition, when the charging unit 100 and the latent-image forming member are simply connected to each other, they will move relative to each other in the image forming operation by a distance corresponding to a gap between the connecting portions. Therefore, the distance between the charging unit 100 and the latent-image forming member cannot be stabilized.

Accordingly, the above-described structure is used to bias the gaps formed when the projecting portions 170 and 171 are inserted in the insertion holes 90A and 91A, respectively, with the spring members 172 and 173. Thus, the photoconductor 62 and the grid electrode 104 are accurately positioned.

In addition, since the latent-image forming member is not in contact with the grid electrode 104 in the above-described structure, the grid electrode 104 having the curved shape may be prevented from being deformed.

In the present exemplary embodiment, the projecting portions 170 and 171 are formed on the charging unit 100 and are fitted into the insertion holes 90A and 91A formed in the housings 90 and 91, respectively. Alternatively, however, insertion holes may be formed in the charging unit 100 and projecting portions formed on the housings 90 and 91 may be fitted into the insertion holes.

In addition, according to the present exemplary embodiment, the leaf springs and torsion springs are used as the spring members 172 and 173 that serve as urging members. However, other types of spring members, such as coil springs, or other materials or members, such as rubber, that are capable of generating a snapping force may be used instead.

In addition, in the above description, the grid electrode 104 is convexly curved toward the charge wires 102A and 102B so that the charging speed of the photoconductor 62 may be increased. More specifically, the attachment portion 104A, the electrode portion 104B, and the attachment portion 104C are curved. However, the grid electrode 104 may instead be formed in a shape that is not curved, that is, in a flat shape.

In the image forming apparatus according to the exemplary embodiment of the present invention, the recording method may be arbitrarily selected. The present invention is applicable to various types of image forming apparatuses, such as a tandem-type image forming apparatus, that record images by using toner.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment wax chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a latent-image forming member including a cylindrical latent-image carrier and support members that are disposed at both ends of the latent-image carrier, the latent-image carrier being rotatably supported by the support members;

a charging member including a discharge electrode that discharges electricity to supply an electric charge to the latent-image carrier and a control electrode that is disposed between the discharge electrode and the latent-image carrier and controls a potential of the latent-image carrier, the charging member charging an outer peripheral surface of the latent-image carrier to a preset potential;

a first connecting portion and a second connecting portion that are respectively formed on the latent-image forming member and the charging member and that are connected to each other to connect the latent-image forming member and the charging member to each other; and an urging member that is disposed between each of the support members and the charging member and urges the latent-image forming member and the charging member away from each other.

2. The image forming apparatus according to claim 1, wherein the first connecting portion, the second connecting portion, and the urging member are provided at each end of the charging member in a longitudinal direction.

3. The image forming apparatus according to claim 1, wherein the urging member is an elastic member.

4. The image forming apparatus according to claim 1, wherein the discharge electrode comprises at least one wire.

5. The image forming apparatus according to claim 1, wherein the control electrode comprises a grid electrode.

6. The image forming apparatus according to claim 5, wherein the grid electrode is curved.

7. An image forming apparatus comprising:

a latent-image forming member including a cylindrical latent-image carrier and support members that are disposed at both ends of the latent-image carrier, the latent-image carrier being rotatably supported by the support members;

a charging member including a discharge electrode that discharges electricity to supply an electric charge to the latent-image carrier and a control electrode that is disposed between the discharge electrode and the latent-image carrier and controls a potential of the latent-image carrier, the charging member charging an outer peripheral surface of the latent-image carrier to a preset potential;

a first connecting portion and a second connecting portion that are respectively formed on the latent-image forming member and the charging member and that are connected to each other to connect the latent-image forming member and the charging member to each other; and an urging member that is disposed between the latent-image forming member and the charging member and urges the latent-image forming member and the charging member away from each other, wherein the urging member comprises at least one elastic spring.

8. An image forming apparatus comprising:

a latent-image forming member including a cylindrical latent-image carrier and support members that are disposed at both ends of the latent-image carrier, the latent-image carrier being rotatably supported by the support members;

a charging member including a discharge electrode that discharges electricity to supply an electric charge to the latent-image carrier and a control electrode that is disposed between the discharge electrode and the latent-image carrier and controls a potential of the latent-image carrier, the charging member charging an outer peripheral surface of the latent-image carrier to a preset potential;

a first connecting portion and a second connecting portion that are respectively formed on the latent-image forming member and the charging member and that are connected to each other to connect the latent-image forming member and the charging member to each other; and an urging member that is disposed between the latent-image forming member and the charging member and urges the latent-image forming member and the charging member away from each other, wherein:

the support members comprise two support members, one support member provided at each end of the latent-image carrier, the first connecting portion comprises two insertion holes, one formed through each of the support members in an axial direction of the latent-image carrier, and the second connection portion comprises two projection portions that project from the charging member in the axial direction, wherein the projection portions are inserted into respective ones of the insertion holes.

* * * * *